US010018367B2

(12) United States Patent
Han et al.

(10) Patent No.: US 10,018,367 B2
(45) Date of Patent: Jul. 10, 2018

(54) AIR CONDITIONER

(71) Applicant: GD MIDEA AIR-CONDITIONING EQUIPMENT CO., LTD., Foshan (CN)

(72) Inventors: Yu Han, Foshan (CN); Jinbo Li, Foshan (CN); Qinghao Meng, Foshan (CN); Mingyu Chen, Foshan (CN); Xiangbing Zeng, Foshan (CN)

(73) Assignee: GD Midea Air-Conditioning Equipment Co., Ltd., Foshan (CN)

( * ) Notice: Subject to any disclaimer, the term of this patent is extended or adjusted under 35 U.S.C. 154(b) by 0 days.

(21) Appl. No.: 15/518,908

(22) PCT Filed: Apr. 20, 2015

(86) PCT No.: PCT/CN2015/077022
§ 371 (c)(1),
(2) Date: Apr. 13, 2017

(87) PCT Pub. No.: WO2016/065868
PCT Pub. Date: May 6, 2016

(65) Prior Publication Data

US 2017/0241652 A1 Aug. 24, 2017

(30) Foreign Application Priority Data

Oct. 28, 2014 (CN) ..... 2014 1 0594225
Oct. 28, 2014 (CN) ..... 2014 2 0635842 U

(51) Int. Cl.
*F24F 1/24* (2011.01)
*F24F 5/00* (2006.01)
*F25B 41/04* (2006.01)

(52) U.S. Cl.
CPC ..... *F24F 1/24* (2013.01); *F24F 5/001* (2013.01); *F25B 41/04* (2013.01)

(58) Field of Classification Search
CPC .. F25B 41/04; F25B 5/02; F25B 30/06; F25B 41/02; F25B 47/022; F25B 40/04;
(Continued)

(56) References Cited

U.S. PATENT DOCUMENTS 4,179,894 A * 12/1979 Hughes ..... F24D 11/0221 62/79
5,038,580 A * 8/1991 Hart ..... F24J 3/081 62/260
(Continued)

FOREIGN PATENT DOCUMENTS

CN 102635986 A 8/2012
CN 202562147 U 11/2012
(Continued)

OTHER PUBLICATIONS

PCT/CN2015/077022 English translation of the International Search Report dated Jul. 2, 2015, 3 pages.
(Continued)

*Primary Examiner* — Mohammad M Ali
(74) *Attorney, Agent, or Firm* — Lathrop Gage LLP

(57) ABSTRACT

An air conditioner (100), comprising a compressor (110), a reversing assembly (120), an outdoor heat exchanger (130), an indoor heat exchanger (140), an electric control heat sink assembly (150), a first unidirectional throttle valve (160) and a second unidirectional throttle valve (160'). The electric control heat sink assembly (150) comprises an electric control component (151) and a heat dissipation assembly (152). The first unidirectional throttle valve (160), on the flow direction from a first valve port (161) to a second valve port (162), is completely turned on. On the flow direction from the second valve port (162) to the first valve port (161), the first unidirectional throttle valve (160) is a throttle component. The second unidirectional throttle valve (160'), on the flow direction from a third valve port (161') to a
(Continued)

fourth valve port (162'), is completely turned on. On the flow direction from the fourth valve port (162') to the third valve port (161'), the second unidirectional throttle valve (160') is a throttle component.

10 Claims, 2 Drawing Sheets

(58) Field of Classification Search
CPC .. F24F 1/24; F24F 5/001; F24F 1/0003; F24F 1/44
USPC ..... 62/259.2
See application file for complete search history.

(56) References Cited

U.S. PATENT DOCUMENTS 5,651,265 A * 7/1997 Grenier ..... F24J 3/081 165/45
5,802,864 A * 9/1998 Yarbrough ..... F25B 13/00 62/238.6
7,591,145 B1 * 9/2009 Wiggs ..... F24F 3/14 62/176.6
2002/0174673 A1 * 11/2002 Wilkinson ..... F24D 5/12 62/260
2004/0103681 A1 * 6/2004 Aflekt ..... F24F 3/1405 62/278

FOREIGN PATENT DOCUMENTS

| | | | |
|---|---|---|---|
| CN | 102844980 | A | 12/2012 |
| CN | 103175262 | A | 6/2013 |
| CN | 103604170 | A | 2/2014 |
| CN | 103688605 | A | 3/2014 |
| CN | 104089346 | A | 10/2014 |
| CN | 204227552 | U | 3/2015 |
| CN | 204555188 | U | 8/2015 |
| JP | H0914781 | A | 1/1997 |

OTHER PUBLICATIONS

Chinese Patent Application No. 201410594225.4 First Office Action dated Jan. 26, 2018, 7 pages.
Chinese Patent Application No. 201410594225.4 English translation of First Office Action dated Jan. 26, 2018, 5 pages.

* cited by examiner

AIR CONDITIONER

FIELD

The present disclosure relates to a field of air conditioning technology and more particularly to an air conditioner.

BACKGROUND

With the development of air conditioning technologies, a variable frequency air conditioner has been applied widely in the industry. However, in an outdoor electrical control system of the variable frequency air conditioner, heat production of a frequency conversion module is large, which limits a high frequency operation of a compressor under a high temperature environment. A heat dissipation mode of the electrical control system which is mostly used currently is that a metal cooling fin dissipates heat through air convection. However, under the outdoor high temperature environment, the heat dissipation mode has a poor effect, and it is a common practice to reduce the heat production of the electrical control system by decreasing an operation frequency of the compressor, so as to ensure that the air conditioner operates normally, thereby greatly affecting a cooling effect of the variable frequency air conditioner when the outdoor ambient temperature during use is high and affecting the use comfortability of an user. In the existing art, the heat dissipation technology for the electrical control system of an outdoor unit through a low temperature coolant has problems that condensation water may be produced or the temperature of the electrical control system of the outdoor unit drops too much, which affects use reliability and safety of the electrical control system. For example, in Chinese patent publication No. CN102844980, titled "Refrigeration Apparatus", not only a product is hard to be formed due to a complicated refrigeration system design, poor processability, complex program control and high cost, but also an energy efficiency loss is great because in a refrigeration circulation, a throttled part of a coolant may absorb heat of a power device.

SUMMARY

Embodiments of the present disclosure seek to solve at least one of the problems existing in the related art to at least some extent. To this end, the present disclosure provides an air conditioner, which has advantages of good use performance and high stability.

The air conditioner according to embodiments of the present disclosure includes: a compressor having a discharge port and a return port; a reversing assembly including a first port, a second port, a third port and a fourth port, in which the first port is communicated with one of the second port and the third port, and the fourth port is communicated with the other of the second port and the third port, the first port is connected to the discharge port and the fourth port is connected to the return port; an outdoor heat exchanger and an indoor heat exchanger, in which a first end of the outdoor heat exchanger is connected to the second port, and a first end of the indoor heat exchanger is connected to the third port; a heat sink assembly including an electrical control element and a heat dissipation subassembly for heat dissipation of the electrical control element, in which the heat dissipation subassembly is in series connection between a second end of the indoor heat exchanger and a second end of the outdoor heat exchanger; a first one-way throttle valve including a first valve port and a second valve port, in which the first valve port is connected to the second end of the outdoor heat exchanger and the second valve port is connected to the heat dissipation subassembly, in a flowing direction from the first valve port to the second valve port, the first one-way throttle valve is fully turned on, and in a flowing direction from the second valve port to the first valve port, the first one-way throttle valve is a throttling element; and a second one-way throttle valve including a third valve port and a fourth valve port, in which the third valve port is connected to the second end of the indoor heat exchanger, and the fourth valve port is connected to the heat dissipation subassembly, in a flowing direction from the third valve port to the fourth valve port, the second one-way throttle valve is fully turned on, and in a flowing direction from the fourth valve port to the third valve port, the second one-way throttle valve is a throttling element.

In the air conditioner according to embodiments of the present disclosure, by disposing the first one-way throttle valve and the second one-way throttle valve in series connection between the outdoor heat exchanger and the indoor heat exchanger, when the coolant flows from the outdoor heat exchanger to the indoor heat exchanger, the first one-way throttle valve will be fully turned on for circulation and the second one-way throttle valve will play a role of throttling. When the coolant flows from the indoor heat exchanger to the outdoor heat exchanger, the second one-way throttle valve will be fully turned on for circulation and the first one-way throttle valve will play the role of throttling. Thus, whether the air conditioner is under a refrigeration mode or a heating mode, the coolant may dissipate heat for the electrical control element, thereby reducing the temperature of the electrical control element, improving the working stability of the electrical control element, simplifying the structure of the air conditioner and reducing the production cost. At the same time, as the coolant is not throttled before flowing into the heat dissipation subassembly, the production of condensed water is effectively reduced, the refrigeration and heat effects of the air conditioner are improved, and the using performance and market competitiveness of the air conditioner are enhanced.

Preferably, the reversing assembly is configured as a four-way valve.

According to an embodiment of the present disclosure, the heat dissipation subassembly includes: a heat dissipation pipe in series connection between the indoor heat exchanger and the outdoor heat exchanger; and a heat dissipation casing, in which the heat dissipation pipe is disposed to the heat dissipation casing, and the heat dissipation casing is in contact with the electrical control element for the heat dissipation of the electrical control element.

Furthermore, the heat dissipation casing includes: a heat dissipation substrate in contact with the electrical control element; and a fixed baffle disposed to the heat dissipation substrate, in which an accommodating space for accommodating the heat dissipation pipe is defined between the fixed baffle and the heat dissipation substrate.

In an embodiment of the present disclosure, two ends of the heat dissipation pipe extend out from opposite sidewalls of the heat dissipation casing, so as to be connected to the first one-way throttle valve and the second one-way throttle valve respectively.

In another embodiment of the present disclosure, the two ends of the heat dissipation pipe extend out from the same side of the heat dissipation casing, so as to be connected to the first one-way throttle valve and the second one-way throttle valve respectively.

Optionally, an end surface of the heat dissipation substrate facing the fixed baffle is provided with a first groove, an end surface of the fixed baffle facing the heat dissipation substrate is provided with a second groove, and the first groove and the second groove are fitted to define the accommodating space.

Preferably, cross sections of the first groove and the second groove are configured to be semicircle separately.

Preferably, the fixed baffle is provided with a fixed column, the heat dissipation substrate is provided with a fixed hole, and the fixed column and the fixed hole are connected by riveting.

Preferably, the accommodating space has the same shape as the heat dissipation pipe.

REFERENCE NUMERALS

Figure 1:
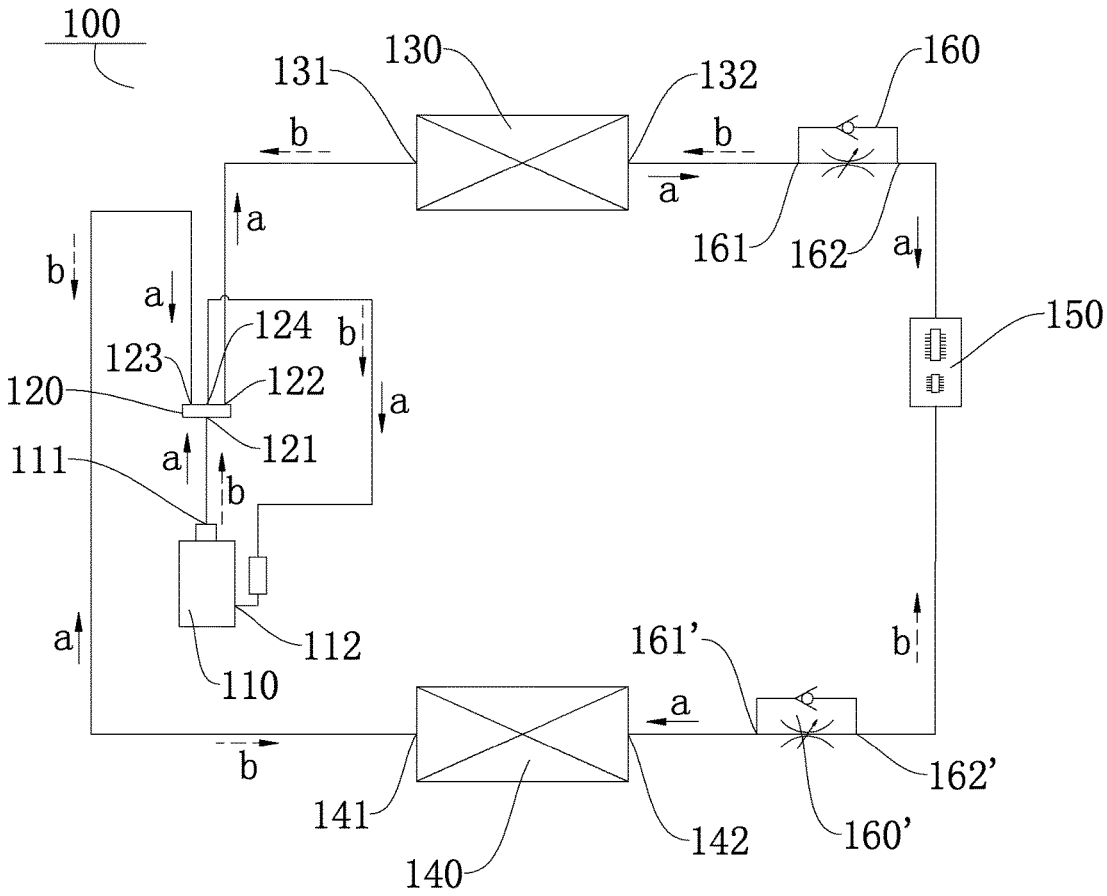
FIG. 1 is a schematic view of an air conditioner according to an embodiment of the present disclosure.

Air conditioner 100,

Compressor 110, discharge port 111, return port 112,

Reversing assembly 120, first port 121, second port 122, third port 123, fourth port 124, Outdoor heat exchanger 130, first end 131 of the outdoor heat exchanger, second end 132 of the outdoor heat exchanger, Indoor heat exchanger 140, first end 141 of the indoor heat exchanger, second end 142 of the indoor heat exchanger, Heat sink assembly 150, electrical control element 151, Heat dissipation subassembly 152, heat dissipation pipe 1521, heat dissipation casing 1522, heat dissipation substrate 1523, fixed baffle 1524, accommodating space 1525, First one-way throttle valve 160, first valve port 161, second valve port 162, Second one-way throttle valve 160', third valve port 161', fourth valve port 162', Casing 163, chamber 1631, Valve plug 164, passage 1641, first segment 1642, second segment 1643, communicating hole 1644, Movable part 165, throttling channel 1651.

DETAILED DESCRIPTION

Reference will be made in detail to embodiments of the present disclosure. The embodiments described herein with reference to drawings are explanatory, illustrative, and used to generally understand the present disclosure. The embodiments shall not be construed to limit the present disclosure.

In the following, an air conditioner 100 according to embodiments of the present disclosure will be described in detail with reference to FIGS. 1-4.

As shown in FIGS. 1-4, the air conditioner 100 according to embodiments of the present disclosure includes a compressor 110, a reversing assembly 120, an outdoor heat exchanger 130, an indoor heat exchanger 140, a heat sink assembly 150, a first one-way throttle valve 160 and a second one-way throttle valve 160'.

Specifically, the compressor 110 has a discharge port 111 and a return port 112. After being compressed into gas of high temperature and high pressure by the compressor 110, a coolant is discharged from the discharge port 111. Then after a cycle, the coolant returns to the compressor 110 through the return port 112. The reversing assembly 120 includes a first port 121, a second port 122, a third port 123 and a fourth port 124, in which the first port 121 is communicated with one of the second port 122 and the third port 123, and the fourth port 124 is communicated with another one of the second port 122 and the third port 123, the first port 121 is connected to the discharge port 111 and the fourth port 124 is connected to the return port 112. A first end 131 of the outdoor heat exchanger is connected to the second port 122 and a first end 141 of the indoor heat exchanger is connected to the third port 123.

Figure 2:
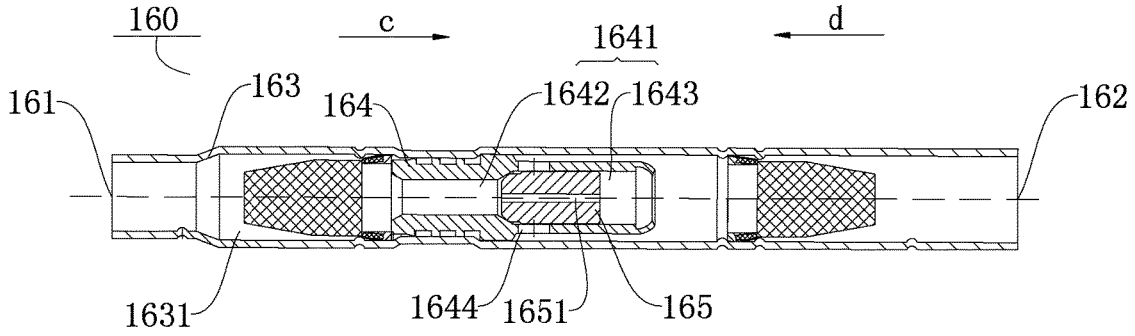
FIG. 2 is a sectional view of a first one-way throttle valve shown in FIG. 1.

As shown in FIG. 1 and FIG. 2, the heat sink assembly 150 may include an electrical control element 151 and a heat dissipation subassembly 152 for heat dissipation of the electrical control element 151. The heat dissipation subassembly 152 is in series connection between a second end 142 of the indoor heat exchanger and a second end 132 of the outdoor heat exchanger. It should be noted that, during operation of the air conditioner 100, the electrical control element 151 is a heating element, and in order to ensure working stability of the electrical control element 151, the heat dissipation subassembly 152 is needed for heat dissipation of the electrical control element 151.

As shown in FIG. 2, the first one-way throttle valve 160 includes a first valve port 161 and a second valve port 162. The first valve port 161 is connected to the second end 132 of the outdoor heat exchanger and the second valve port 162 is connected to the heat dissipation subassembly 152. In a flowing direction from the first valve port 161 to the second valve port 162, the first one-way throttle valve 160 is fully turned on, and only acts as a connecting pipe. In a flowing direction from the second valve port 162 to the first valve port 161, the first one-way throttle valve 160 is a throttling valve, which plays a role of throttling. The term "fully turned on" herein means that as pressure at both ends of the first one-way throttle valve 160 is substantially equal, the first one-way throttle valve 160 only acts as the connecting pipe instead of playing the role of throttling, and the coolant may flow smoothly from the first valve port 161 to the second valve port 162.

The second one-way throttle valve 160' includes a third valve port 161' and a fourth valve port 162'. The third valve port 161' is connected to the second end 142 of the indoor heat exchanger, and the fourth valve port 162' is connected to the heat dissipation subassembly 152. In a flowing direction from the third valve port 161' to the fourth valve port 162', the second one-way throttle valve 160' is fully turned on, and only acts as a connecting pipe. In a flowing direction from the fourth valve port 162' to the third valve port 161', the second one-way throttle valve 160' is a throttling valve, which plays a role of throttling. The term "fully turned on" herein means that as pressure at both ends of the second one-way throttle valve 160' is substantially equal, the second one-way throttle valve 160' only acts as the connecting pipe instead of playing the role of throttling, and the coolant may flow smoothly from to the third valve port 161' to the fourth valve port 162'.

In the following, the first one-way throttle valve 160 is taken as an example for describing the structure of the first one-way throttle valve 160 and a flowing process of the coolant in the first one-way throttle valve 160 in detail. It should be noted that, the structure of the second one-way throttle valve 160' is the same as that of the first one-way throttle valve 160, and the flowing process of the coolant in the second one-way throttle valve 160' is the same as that in the first one-way throttle valve 160, which will not be elaborated herein.

For example, in the embodiment shown in FIG. 2, the first one-way throttle valve 160 may include a casing 163, a valve plug 164 and a movable part 165. The casing 163 has a chamber 1631 therein, and the valve plug 164 is disposed in the chamber 1631. The valve plug 164 is provided with a passage 1641 communicated with the chamber 1631. A first end of the passage 1641 is located adjacent to the first valve port 161 and the second end of the passage 1641 is located adjacent to the second valve port 162. The passage 1641 includes a first segment 1642, and a second segment 1643 communicated with the first segment 1642. A cross sectional area of the first segment 1642 is smaller than that of the second segment 1643. An outer circumferential wall of the first segment 1642 fits closely with an inner wall of the chamber 1631, a gap is provided between an outer circumferential wall of the second segment 1643 and the inner wall of the chamber 1631, and a side wall of the second segment 1643 is provided with a plurality of communicating holes 1644 communicated with the chamber 1631. Preferably, a sum of cross sectional areas of the plurality of communicating holes 1644 is larger than or equal to a cross sectional area of the second segment 1643. The movable part 165 is slidably disposed in the second segment 1643 so as to open or close the communicating hole 1644, and an outer circumferential wall of the movable part 165 fits closely with an inner wall of the second segment 1643. The movable part 165 is provided with a throttling channel 1651. A first end of the throttling channel 1651 is located adjacent to the first valve port 161, and a second end of the throttling channel 1651 is located adjacent to the second valve port 162. A cross sectional area of the throttling channel 1651 is far smaller than the cross sectional area of the second segment 1643. When the movable part 165 moves to a position adjacent to the second valve port 162, the communicating hole 1644 is opened by the movable part 165, and the second segment 1643 of the passage 1641 may be communicated with the chamber 1631 through the communicating hole 1644. When the movable part 165 moves to a position adjacent to the first valve port 161, the communicating hole 1644 is closed by the movable part 165, the passage 1641 cannot be communicated with the chamber 1631 through the communicating hole 1644, and the coolant is communicated with the chamber 1631 through the throttling channel 1651.

When the coolant flows from the first valve port 161 to the second valve port 162, as along a direction shown by arrow C of FIG. 2, the coolant enters the chamber 1631 from the first valve port 161, and then enters the first segment 1642 of the passage 1641 through the first end of the passage 1641 of the valve plug 164. Under the drive of the coolant, the movable part 165 moves along the direction shown by arrow C in the second segment 1643, and the movable part 165 opens the communicating hole 1644. After entering the second segment 1643 from the first segment 1642, the coolant enters the chamber 1631 through the communicating hole 1644, and at the time the first one-way throttle valve 160 only acts as the connecting pipe, i.e., the pressure at both sides of the passage 1641 is substantially equal. When the coolant flows to the first valve port 161 from the second valve port 162, as along a direction shown by arrow d of FIG. 2, the coolant enters the chamber 1631 from the second valve port 162, and then enters into the second segment 1643 of the passage 1641 through the second end of the passage 1641 of the valve plug 164. Under the drive of the coolant, the movable part 165 moves along the direction shown by arrow d in the second segment 1643, and the movable part closes the communicating hole 1644. After entering the second segment 1643 from the chamber 1631, the coolant enters the first segment 1642 through the throttling channel 1651, then flows out from the first end of the passage 1641, and enters the chamber 1631. As the cross sectional area of the throttling channel 1651 is far smaller than the cross sectional area of the second segment 1643, the pressure at both sides of the passage 1641 is greatly different, and at the time the first one-way throttle valve 160 plays the role of throttling.

In the following, a working process of the air conditioner 100 according to embodiments of the present disclosure will be described in detail with reference to FIG. 1 and FIG. 2.

As shown in FIG. 1, when the air conditioner 100 is in a refrigeration mode, with respect to the reversing assembly 120, the first port 121 is communicated with the second port 122, and the third port 123 is communicated with the fourth port 124. As in a direction shown by arrow a of FIG. 1, after being compressed into the gas of high temperature and high pressure by the compressor 110, the coolant is discharged from the discharge port 111. The coolant enters the reversing assembly 120 from the first port 121, flows through the second port 122 of the reversing assembly 120 and the first end 131 of the outdoor heat exchanger successively, and then enters the outdoor heat exchanger 130. As shown in FIG. 1 and FIG. 2, after flowing out from the second end 132 of the outdoor heat exchanger, the coolant enters the first one-way throttle valve 160 from the first valve port 161 of the first one-way throttle valve 160 and flows out from the second valve port 162 of the first one-way throttle valve 160. The first one-way throttle valve 160 is fully turned on, and only acts as the connecting pipe.

After flowing out from the second valve port 162 of the first one-way throttle valve 160, the coolant flows through the heat dissipation subassembly 152, then enters the second one-way throttle valve 160' from the fourth valve port 162' of the second one-way throttle valve 160', and flows from the fourth valve port 162' to the third valve port 161'. At the time the second one-way throttle valve 160' plays the role of throttling.

After flowing out from the third valve port 161', the coolant enters the indoor heat exchanger 140 from the second end 142 of the indoor heat exchanger, flows out from the first end 141 of the indoor heat exchanger, then enters the reversing assembly 120 from the third port 123 of the reversing assembly 120, and returns to the compressor 110 after flowing through the fourth port 124 and the return port 112 successively. So far the air conditioner 100 has accomplished the refrigerating process.

It should be noted that, under the refrigeration mode of the air conditioner 100, the gaseous coolant of high temperature and high pressure, discharged from the discharge port 111, is condensed to dissipate heat in the outdoor heat exchanger 130, and the temperature of the coolant flowing out from the outdoor heat exchanger 130 is slightly above the environment temperature. Because at the time the first one-way throttle valve 160 is fully turned on and does not play the role of throttling, and only the second one-way throttle valve 160' plays the role of throttling as the throttling element, the temperature of the coolant remains substantially unchanged when flowing through the first one-way throttle valve 160, i.e., the temperature of the coolant is still slightly above the environment temperature. When flowing through the heat dissipation subassembly 152, the coolant, whose temperature is slightly above the environment temperature, may dissipate heat for the electrical control element 151 and may prevent the production of the condensed water. The coolant throttled by the second one-way throttle valve 160' enters the indoor heat exchanger 140 and evaporates to absorb heat in the indoor heat exchanger 140, and eventually returns to the compressor 110.

Thus, under the refrigeration mode of the air conditioner 100, the coolant may dissipate heat for the electrical control element 151 effectively, thereby reducing the temperature of the electrical control element 151 and improving the stability of the electrical control element 151. In addition, as the temperature of the coolant flowing out from the outdoor heat exchanger 130 is slightly above the environment temperature, the coolant may reduce the production of the condensed water effectively during the heat dissipation for the electrical control element 151, thereby further improving the working stability of the electrical control element 151.

As shown in FIG. 1, when the air conditioner 100 is in a heating mode, with respect to the reversing assembly 120, the first port 121 is communicated with the third port 123, and the second port 122 is communicated with the fourth port 124. As in a direction shown by arrow b of FIG. 1, after being compressed into the gas of high temperature and high pressure by the compressor 110, the coolant is discharged from the discharge port 111. The coolant enters the reversing assembly 120 from the first port 121, flows through the third port 123 of the reversing assembly 120 and the first end 141 of the indoor heat exchanger successively, and then enters into the indoor heat exchanger 140. After flowing out from the second end 142 of the indoor heat exchanger, the coolant enters the second one-way throttle valve 160' from the third valve port 161' of the second one-way throttle valve 160' and flows from the third valve port 161' to the fourth valve port 162'. At the time the second one-way throttle valve 160' is fully turned on, and does not play the role of throttling.

When flowing out from the fourth valve port 162', the coolant flows through the heat dissipation subassembly 152, then enters the first one-way throttle valve 160 from the second valve port 162 of the first one-way throttle valve 160, and flows from the second valve port 162 to the first valve port 161. At the time, the first one-way throttle valve 160 functions as the throttling element and plays the role of throttling. The coolant flowing out from the first valve port 161 of the first one-way throttle valve 160 enters the outdoor heat exchanger 130 from the second end 132 of the outdoor heat exchanger, and flows out from the first end 131 of the outdoor heat exchanger. The coolant enters the reversing assembly 120 from the second port 122 and returns to the compressor 110 after flowing through the fourth port 124 and the return port 112 successively. So far the air conditioner 100 has accomplished the heating process.

It should be noted that, under the heating mode of the air conditioner 100, the gaseous coolant of high temperature and high pressure, discharged from the discharge port 111, is condensed to dissipate heat in the indoor heat exchanger 140, and the temperature of the coolant flowing out from the indoor heat exchanger 140 is above the environment temperature. Because the second one-way throttle valve 160' is fully turned on and does not play the role of throttling, the temperature of the coolant, whose the temperature is above the environment temperature, remains substantially unchanged when the coolant flows through the second one-way throttle valve 160', and all the coolant flowing out from the second one-way throttle valve 160' will enter the heat dissipation subassembly 152, such that the coolant may dissipate heat for the electrical control element 151 and may reduce the production of the condensed water. After flowing through the heat dissipation subassembly 152, the coolant enters the first one-way throttle valve 160 from the second valve port 162 and flows out from the first valve port 161 of the first one-way throttle valve 160. As the first one-way throttle valve 160 functions as the throttling element and has the role of throttling, after entering the outdoor heat exchanger 130, the coolant evaporates to absorb heat and eventually returns to the compressor 110.

Thus, under the heating mode of the air conditioner 100, the coolant may dissipate heat for the electrical control element 151 effectively, thereby reducing the temperature of the electrical control element 151 and improving the stability of the electrical control element 151. In addition, as the coolant is not throttled before flowing into the heat dissipation subassembly 152, the temperature of the coolant is above the environment temperature, thereby reducing the production of the condensed water effectively.

Moreover, whether the air conditioner 100 is under the refrigeration mode or the heating mode, all the coolant may flow through the heat dissipation subassembly 152. As the flux of the coolant is large, it is possible to achieve a good effect of reducing the temperature of the electrical control element 151, thereby improving the working stability of the electrical control element 151, and then improving the using performance of the air conditioner 100. Moreover, compared with the related art, the air conditioner 100 according to embodiments of the present disclosure has a simpler structure, thereby simplifying a control system, being easy to form the products, and hence reducing the production cost.

In the air conditioner 100 according to embodiments of the present disclosure, by disposing the first one-way throttle valve 160 and the second one-way throttle valve 160' in series connection between the outdoor heat exchanger 130 and the indoor heat exchanger 140, when the coolant flows from the outdoor heat exchanger 130 to the indoor heat exchanger 140, the first one-way throttle valve 160 will be fully turned on for circulation and the second one-way throttle valve 160' will play the role of throttling. When the coolant flows from the indoor heat exchanger 140 to the outdoor heat exchanger 130, the second one-way throttle valve 160' will be fully turned on for circulation and the first one-way throttle valve 160 will play the role of throttling. Thus whether the air conditioner 100 is under the refrigeration mode or the heating mode, the coolant may dissipate heat for the electrical control element 151, thereby reducing the temperature of the electrical control element 151, improving the working stability of the electrical control element 151, simplifying the structure of the air conditioner 100 and reducing the production cost. At the same time, as the coolant is not throttled before flowing into the heat dissipation subassembly 152, the production of condensed water is effectively reduced, the refrigeration and heat effects of the air conditioner 100 are improved, and hence the using performance and market competitiveness of the air conditioner 100 are enhanced.

It could be understood that, the structure of the reversing assembly 120 is not particularly limited. The reversing assembly 120 may include a first pipe, a second pipe, a third pipe and a fourth pipe. The first pipe, the second pipe, the third pipe and the fourth pipe are connected head-to-tail in sequence. A first electromagnetic valve is connected to the first pipe in series, and a second electromagnetic valve is connected to the second pipe in series. A third electromagnetic valve is connected to the third pipe in series, and a fourth electromagnetic valve is connected to the fourth pipe in series. The junction of the first pipe and the second pipe defines a first connecting port c, and the junction of the first pipe and the fourth pipe defines a second connecting port d. The junction of the fourth pipe and the third pipe defines a fourth connecting port f, and the junction of the third pipe and the second pipe defines a third connecting port e. The first electromagnetic valve and the third electromagnetic valve open or close at the same time, and the second electromagnetic valve and the fourth electromagnetic valve open or close at the same time. In a preferable embodiment of the present disclosure, the reversing assembly 120 may be configured as a four-way valve.

Figure 3:
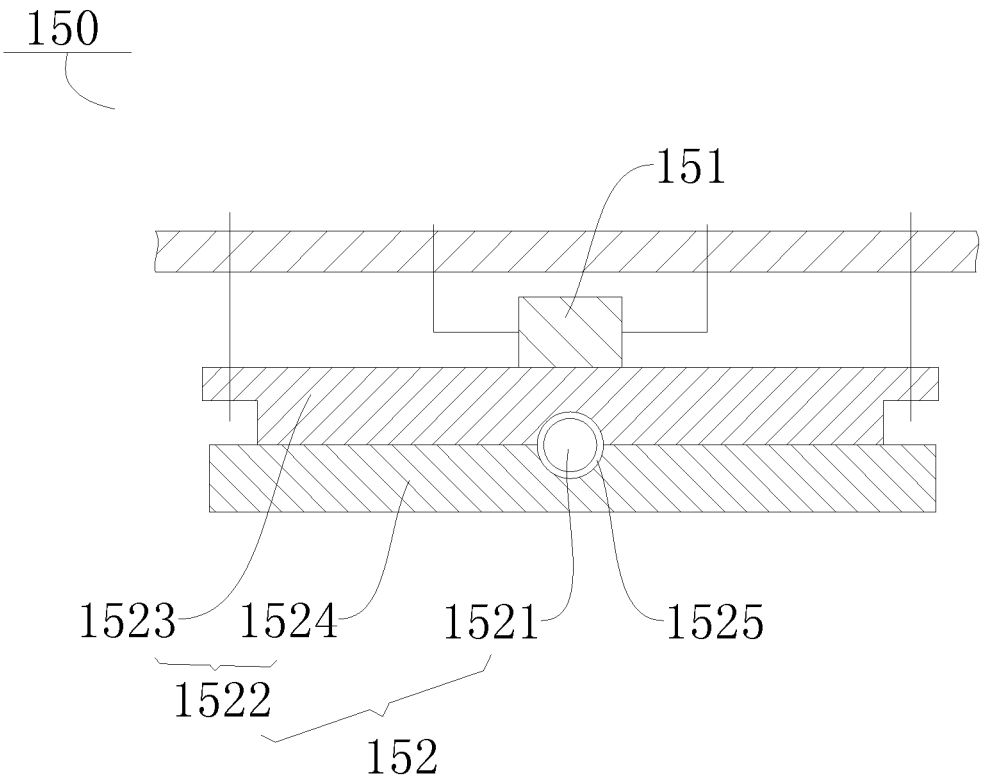
FIG. 3 and FIG. 4 are sectional views of a heat sink assembly according to different embodiments of the present disclosure.
Figure 4:
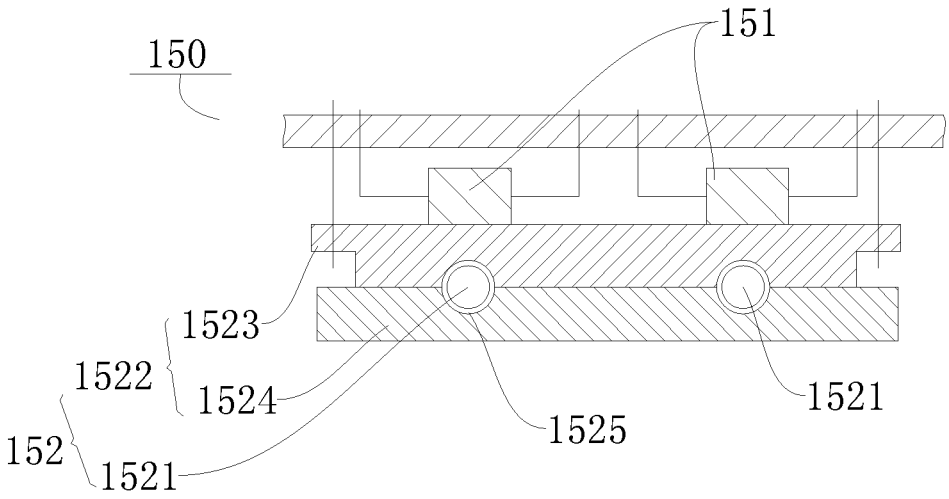

As shown in FIG. 3 and FIG. 4, according to an embodiment of the present disclosure, the heat dissipation subassembly 152 may include: a heat dissipation pipe 1521 and a heat dissipation casing 1522. Preferably, the heat dissipation pipe 1521 is configured as a copper pipe. Thus, a heat exchange efficiency of the heat dissipation pipe 1521 may be improved. The heat dissipation pipe 1521 is in series connection between the indoor heat exchanger 140 and the outdoor heat exchanger 130, and the coolant may flow in the heat dissipation pipe 1521. The heat dissipation pipe 1521 is disposed to the heat dissipation casing 1522, and the heat dissipation casing 1522 is in contact with the electrical control element 151 for the heat dissipation of the electrical control element 151, thus improving a heat dissipation efficiency of the heat dissipation subassembly 152 and ensuring the operation stability of the electrical control element 151.

Furthermore, the heat dissipation casing 1522 may include: a heat dissipation substrate 1523 and a fixed baffle 1524. The heat dissipation substrate 1523 is in contact with the electrical control element 151, and the heat of the electrical control element 151 may be directly transferred to the heat dissipation substrate 1523. The fixed baffle 1524 is disposed to the heat dissipation substrate 1523, so the fixed baffle 1524 may exchange heat with the heat dissipation substrate 1523 directly. It could be understood that, a connection mode between the fixed baffle 1524 and the heat dissipation substrate 1523 is not specially limited. For example, in embodiments shown in FIG. 3 and FIG. 4, the fixed baffle 1524 fits closely with the heat dissipation substrate 1523. Furthermore, the fixed baffle 1524 is provided with a fixed column (not shown in the drawings), the heat dissipation substrate 1523 is provided with a fixed hole (not shown in the drawings), and the fixed column and the fixed hole are connected by riveting, thus enlarging a contact area between the fixed baffle 1524 and the heat dissipation substrate 1523, and further improving the heat exchange efficiency between the fixed baffle 1524 and the heat dissipation substrate 1523.

To further improve the heat dissipation efficiency of the heat dissipation subassembly 152, an accommodating space 1525 for accommodating the heat dissipation pipe 1521 is defined between the fixed baffle 1524 and the heat dissipation substrate 1523, thus enlarging a heat exchange area between the fixed baffle 1524 and the heat dissipation pipe 1521, thereby further improving the heat dissipation efficiency of the heat dissipation subassembly 152 and ensuring the operation stability of the electrical control element 151. Preferably, the accommodating space 1525 has the same shape as the heat dissipation pipe 1521, thus further enlarging the contact area between the heat dissipation pipe 1521 with the fixed baffle 1524 and the heat dissipation substrate 1523. The heat dissipation pipe 1521 may exchange heat with the fixed baffle 1524 and the heat dissipation substrate 1523 directly.

For example, in the embodiments shown in FIG. 3 and FIG. 4, an end surface of the heat dissipation substrate 1523 facing the fixed baffle 1524 is provided with a first groove, an end surface of the fixed baffle 1524 facing the heat dissipation substrate 1523 is provided with a second groove, and the first groove and the second groove are fitted to define the accommodating space 1525, thus facilitating the installation of the heat dissipation pipe 1521 to the heat dissipation casing 1522, and also enlarging the contact area between the heat dissipation pipe 1521 with the heat dissipation substrate 1523 and the fixed baffle 1524. To facilitate the processing, in an embodiment of the present disclosure, cross sections of the first groove and the second groove are configured to be semicircle separately.

In the embodiment shown in FIG. 3, for improving the heat dissipation efficiency of the heat dissipation subassembly 152, two ends of the heat dissipation pipe 1521 extend out from opposite sidewalls of the heat dissipation casing 1522, so as to be connected to the first one-way throttle valve 160 and the second one-way throttle valve 160' respectively. Certainly, positions of the two ends of the heat dissipation pipe 1521 are not limited to this. For further improving the heat dissipation efficiency of the heat dissipation subassembly 152, for example, in the embodiment shown in FIG. 4, the two ends of the heat dissipation pipe 1521 extend out from the same side of the heat dissipation casing 1522, so as to be connected to the first one-way throttle valve 160 and the second one-way throttle valve 160' respectively. For example, the heat dissipation pipe 1521 may be formed as a U-shaped structure, thus prolonging a length of the heat dissipation pipe 1521 in the heat dissipation casing 1522, thereby enlarging the contact area between the heat dissipation pipe 1521 with the heat dissipation substrate 1523 and the fixed baffle 1524, and further improving the heat dissipation efficiency of the heat dissipation subassembly 152.

It is verified by experiments that, under the same working conditions and compared with the air conditioner of the related art, in the air conditioner 100 according to embodiments of the present disclosure, the temperature of the electrical control element 151 may be reduced by more than 15° C. and the high temperature operation frequency of the compressor 110 may be improved by 20 Hz. When the outdoor temperature is above 35° C., the high temperature refrigerating capacity of the air conditioner 100 according to embodiments of the present disclosure is improved by more than 10% compared with the air conditioner of the related art. When the outdoor temperature is above 55° C., the high temperature refrigerating capacity of the air conditioner 100 according to embodiments of the present disclosure is improved by more than 20% compared with the air conditioner of the related art.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" should be construed to refer to the orientation as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. An air conditioner comprising:

a compressor having a discharge port and a return port;

a reversing assembly comprising a first port, a second port, a third port and a fourth port, wherein the first port is communicated with one of the second port and the third port, and the fourth port is communicated with the other of the second port and the third port, the first port is connected to the discharge port and the fourth port is connected to the return port;

an outdoor heat exchanger and an indoor heat exchanger, wherein a first end of the outdoor heat exchanger is connected to the second port, and a first end of the indoor heat exchanger is connected to the third port;

a heat sink assembly comprising an electrical control element and a heat dissipation subassembly for heat dissipation of the electrical control element, wherein the heat dissipation subassembly is in series connection between a second end of the indoor heat exchanger and a second end of the outdoor heat exchanger;

a first one-way throttle valve comprising a first valve port and a second valve port, wherein the first valve port is connected to the second end of the outdoor heat exchanger and the second valve port is connected to the heat dissipation subassembly, in a flowing direction from the first valve port to the second valve port, the first one-way throttle valve is fully turned on, and in a flowing direction from the second valve port to the first valve port, the first one-way throttle valve is a throttling element; and a second one-way throttle valve comprising a third valve port and a fourth valve port, wherein the third valve port is connected to the second end of the indoor heat exchanger, and the fourth valve port is connected to the heat dissipation subassembly, in a flowing direction from the third valve port to the fourth valve port, the second one-way throttle valve is fully turned on, and in a flowing direction from the fourth valve port to the third valve port, the second one-way throttle valve is a throttling element.

2. The air conditioner according to claim 1, wherein the reversing assembly is configured as a four-way valve.

3. The air conditioner according to claim 1, wherein the heat dissipation subassembly comprises:

a heat dissipation pipe in series connection between the indoor heat exchanger and the outdoor heat exchanger; and a heat dissipation casing, wherein the heat dissipation pipe is disposed to the heat dissipation casing, and the heat dissipation casing is in contact with the electrical control element for the heat dissipation of the electrical control element.

4. The air conditioner according to claim 3, wherein the heat dissipation casing comprises:

a heat dissipation substrate in contact with the electrical control element; and a fixed baffle disposed on the heat dissipation substrate, wherein an accommodating space for accommodating the heat dissipation pipe is defined between the fixed baffle and the heat dissipation substrate.

5. The air conditioner according to claim 3, wherein two ends of the heat dissipation pipe extend out from opposite sidewalls of the heat dissipation casing, so as to be connected to the first one-way throttle valve and the second one-way throttle valve respectively.

6. The air conditioner according to claim 3, wherein two ends of the heat dissipation pipe extend out from the same side of the heat dissipation casing, so as to be connected to the first one-way throttle valve and the second one-way throttle valve respectively.

7. The air conditioner according to claim 4, wherein an end surface of the heat dissipation substrate facing the fixed baffle is provided with a first groove, an end surface of the fixed baffle facing the heat dissipation substrate is provided with a second groove, and the first groove and the second groove are cooperated to define the accommodating space.

8. The air conditioner according to claim 7, wherein cross sections of the first groove and the second groove are configured to be semicircle separately.

9. The air conditioner according to claim 4, wherein the fixed baffle is provided with a fixed column, the heat dissipation substrate is provided with a fixed hole, and the fixed column and the fixed hole are connected by riveting.

10. The air conditioner according to claim 4, wherein the accommodating space has the same shape as the heat dissipation pipe.

* * * * *